US006833013B1

(12) United States Patent
Sanfilippo et al.

(10) Patent No.: US 6,833,013 B1
(45) Date of Patent: Dec. 21, 2004

(54) PROCESS FOR THE PRODUCTION OF SYNTHESIS GAS

(75) Inventors: Domenico Sanfilippo, Paullo (IT); Alberto Paggini, Spino d'Adda (IT); Ivano Miracca, Lodi (IT); Carlo Rescalli, S. Donato Mil.se (IT)

(73) Assignee: Snamprogetti S.p.A., San Donato Milanese (IT)

( * ) Notice: Subject to any disclaimer, the term of this patent is extended or adjusted under 35 U.S.C. 154(b) by 0 days.

(21) Appl. No.: 09/557,158

(22) Filed: Apr. 25, 2000

(30) Foreign Application Priority Data

Jan. 13, 2000 (IT) ..... MI2000A26

(51) Int. Cl.[7] ..... C01B 3/32

(52) U.S. Cl. ..... 48/198.5; 48/198.1; 48/198.6; 48/198.7; 252/373; 423/648.1; 423/650; 423/652; 423/656

(58) Field of Search ..... 48/197 R, 198.1, 48/198.5, 198.6, 198.7; 252/373; 423/648.1, 650, 652, 656

(56) References Cited

U.S. PATENT DOCUMENTS

| | | | | | |
|---|---|---|---|---|---|
| 2,602,809 | A | * | 7/1952 | Dickinson | 518/702 |
| 3,965,252 | A | * | 6/1976 | Kmecak et al. | 423/651 |
| 4,272,399 | A | * | 6/1981 | Davis et al. | 252/373 |
| 4,367,160 | A | * | 1/1983 | Rooks et al. | 252/373 |
| 6,007,699 | A | * | 12/1999 | Cole | 208/134 |

* cited by examiner

*Primary Examiner*—Jerry D. Johnson
*Assistant Examiner*—Basia Ridley
(74) *Attorney, Agent, or Firm*—Oblon, Spivak, McClelland, Maier & Neustadt, P.C.

(57) ABSTRACT

Process for the production of synthesis gas, by means of catalytic partial oxidation or autothermal reforming of light hydrocarbons, which comprises partially oxidizing the hydrocarbon with oxygen coming from the reduction of at least one metal oxide selected from hexavalent chromium oxide, supported on an inert carrier and modified with an alkaline and/or earth-alkaline metal, and metal oxides capable of autonomously sustaining the catalytic partial oxidation reaction by means of redox cycles.

15 Claims, 1 Drawing Sheet

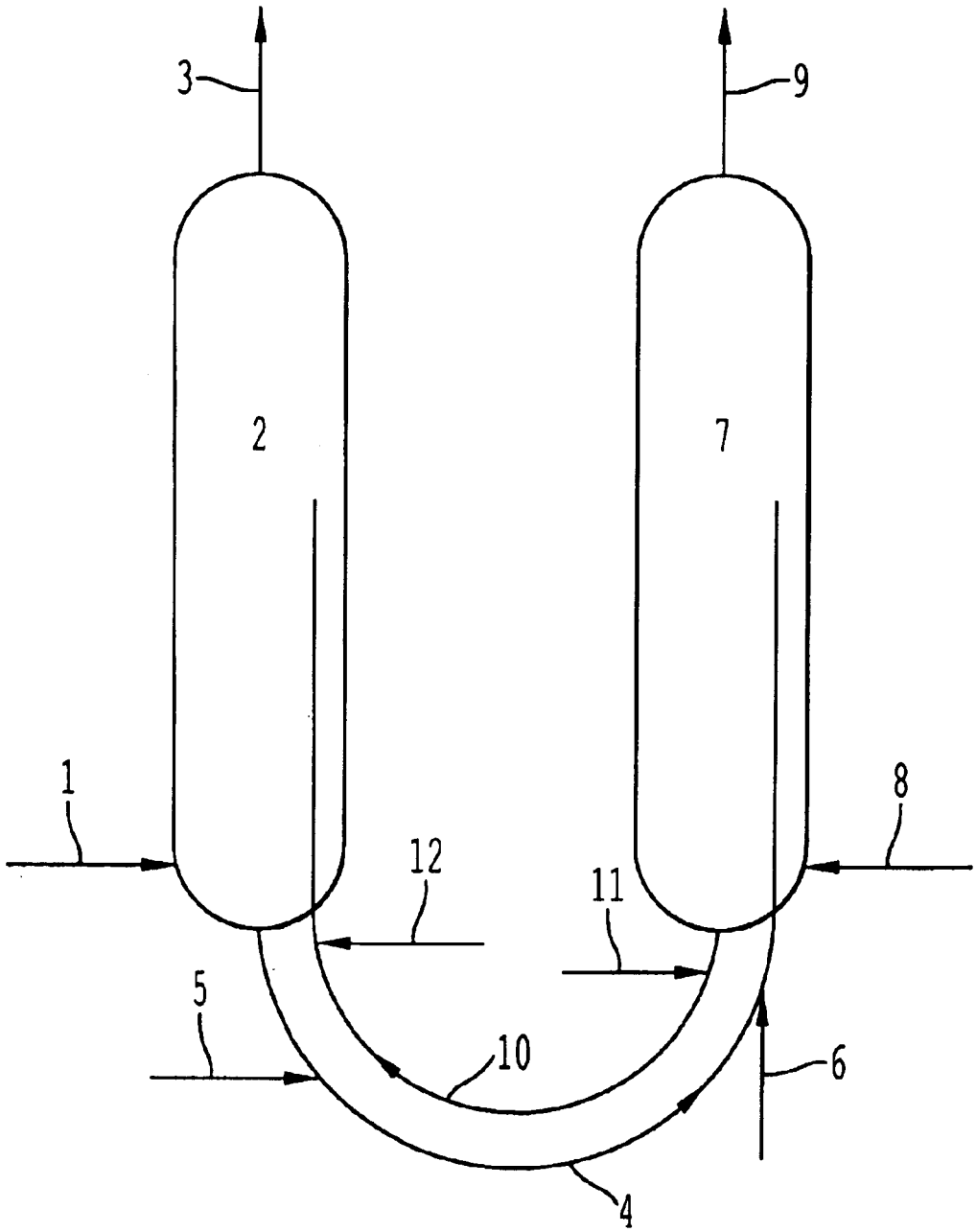
3
9
2
7
1
8
12
11
5
10
6
4

PROCESS FOR THE PRODUCTION OF SYNTHESIS GAS

BACKGROUND OF THE INVENTION

1. Field of the Invention

The present invention relates to a process for the production of synthesis gas.

More specifically, the present invention relates to a process for the production of synthesis gas by means of the autothermal reforming of light hydrocarbons.

Even more specifically, the present invention relates to a process for the production of synthesis gas by means of the autothermal reforming of natural gas and/or methane.

2. Description of the Background

Processes for the production of synthesis gas from light hydrocarbons have been known for a long time. According to the steam reforming technique, methane, or another light hydrocarbon, is reacted with water vapor at a high temperature according to the reaction scheme:

$$CH_4+H_2O=CO+3H_2 \quad (I)$$

The reaction is considerably endothermic, requires in fact about 50 Kcal per mole of converted methane and is therefore not very convenient from an industrial point of view due to the high operating costs associated with the energy consumption.

In order to overcome these limits, an alternative technology has been proposed, known as "partial oxidation" as the heat necessary for the production of synthesis gas derives from the partial oxidation of methane, according to the reaction scheme:

$$CH_4+1/2O_2=CO+H_2 \quad (II)$$

With partial oxidation, moreover, significant quantities of carbon dioxide and water vapor are always formed as the methane is always partially transformed also into these products (total oxidation). The equilibrium of the "shift" reaction therefore tends to be established:

$$CO+H_2O=CO_2+H_2 \quad (III)$$

The high exothermicity of the partial oxidation reaction hinders industrial application as temperatures much higher than 1000° C. are reached under adiabatic conditions, considerably increasing the investment costs relating to the materials and construction technologies.

The application of the autothermal reforming reaction has become widely used in the last few years, and is carried out by contemporaneously feeding pure oxygen, as primary oxygen source, and methane, or another light hydrocarbon, with water vapor to the synthesis reactor so that reactions (I) and (II) take place contemporaneously and the endothermicity of the one compensates the exothermicity of the other, ensuring that there is no distinct production or consumption of heat. Also in this case, however, the process is not very convenient as the use of pure oxygen as primary oxygen source requires the running of a cryogenic unit for the separation of air, whose investment and operating cost greatly jeopardizes the oxidative reforming process. In fact, in a process for the production of synthesis gas by means of autothermal reforming, more than 50% of the production cost is linked to the production of oxygen. On the other hand, it is also not very convenient to use air as such or enriched, as the nitrogen present in the air itself would dilute the synthesis gas to a degree which is not acceptable for most applications.

To overcome this latter problem, the use of metal oxides capable of being reduced by methane or another hydrocarbon, has been proposed, as primary oxygen source. In "Industrial and Engineering Chemistry," Vol. 41, Nr. 6, 1227–1237 (1949) a catalytic partial oxidation process of methane is described wherein the oxygen source consists of copper oxide which proves to be a very active oxidizing agent and which can be easily re-oxidized by means of air. The patent U.S. Pat. No. 5,799,482, in particular, describes a process for the production of synthesis gas in which the partial oxidation of a light hydrocarbon is effected continuously, to produce synthesis gas, using as primary oxygen source, a metal oxide capable of undergoing continuous reduction/oxidation (redox) cycles. Oxides cited as being particularly suitable for undergoing redox reaction cycles are oxides of copper, chromium, cobalt, iron, manganese, their mixtures or, alternatively, binary or ternary metal oxides.

The embodiment of the continuous process described in the U.S. Pat. No. 5,799,482 comprises the use of two fluid bed reactors. The first reactor (autothermal reactor), operating at a preferred temperature of 1600–1850° F. and at a pressure of 150–450 psig, contains the metal oxide, and an optional catalyst which activates the partial oxidation reaction according to schemes (II) and (III), and is fed continuously with the light hydrocarbon to be oxidized. The second reactor (combustor/regenerator), operating at a temperature higher than that of the first, contains the reduced metal oxide and is fed continuously with a fuel mixture (air/methane) to burn the carbonaceous residues present on the solid and re-oxidize the metal.

The two reactors are connected to each other and continuously exchange the exhausted oxide and regenerated oxide. According to this process, moreover, the exhausted gases leaving the regenerator are mixed with fresh air at a high pressure and used in a gas turbine to produce energy.

The process of patent U.S. Pat. No. 5,799,482 also has its drawbacks. In fact, the reduction of the metal oxide is endothermic and, even in the case of pure catalytic partial oxidation, in order to keep the reaction temperature constant in the first reactor, heat is supplied by recycling the regenerated oxide at a temperature higher than the oxidation temperature, thus increasing the investment and operating costs. In addition, the oxidative action of the oxide must be integrated with supplementary oxidizing gas, for example pure oxygen, air as such or enriched air, thus conserving, although in reduced form, the disadvantages of the previous technologies.

SUMMARY OF THE INVENTION

An objective of the present invention is to provide a process for the production of synthesis gas by means of catalytic partial oxidation or autothermal reforming in which the primary oxygen source is represented by a metal oxide capable of undergoing redox cycles which does not have the drawbacks described above.

More specifically, the objective of the present invention is to provide a process for the production of synthesis gas which is actually autothermal and which consequently does not require any heat supplement, supplied externally for example, by means of the regenerated and recycled metal oxide, and in which the primary oxygen source is exclusively represented by a metal oxide capable of undergoing redox cycles, without any additional oxidative sources.

BRIEF DESCRIPTION OF THE DRAWING

The FIGURE shows an embodiment of the apparatus used in the process of the invention of producing synthesis gas in which a light hydrocarbon is oxidized in an oxidation reactor and catalyst is regenerated in a regeneration reactor.

DETAILED DESCRIPTION OF THE PREFERRED EMBODIMENTS

The Applicant has succeeded in obtaining the desired objectives as it has been found that there are metal oxides capable of autonomously sustaining the catalytic partial oxidation reaction by means of the above redox cycles. In particular, it has been surprisingly found that hexavalent chromium oxide has the required requisites. The redox reaction of chromium between oxidation states III and VI can be described as follows:

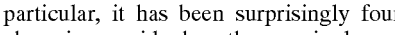

$$4CrO_3=2Cr_2O_3+3O_2 \quad \text{(IV)}$$

As the transfer of oxygen on the part of hexavalent chromium oxide is slightly endothermic (9.5 Kcal/mol) whereas the reaction for producing synthesis gas from light hydrocarbons, for example methane, by means of partial oxidation, is exothermic (from a minimum theoretical value of 8.5 Kcal/mol to 20–30 Kcal/mole in relation to the various operating conditions), the overall reaction which takes place in the synthesis reactor, when the oxygen for the partial oxidation of methane is supplied according to reaction (IV), remains exothermic, contrary to when the oxygen is supplied by the reduction of other oxides indicated in literature such as, for example, trivalent chromium.

This factor leads to two fundamental advantages in the industrial exploitation of this reactive system:

- the circulation of solid from the regenerator to the reactor does not have to supply heat but only the oxygen necessary for the reaction. The transporting of the solid can therefore be optimized on this single parameter;
- the regenerator can operate at a temperature which is lower than or equal to that of the reactor with a great saving in investment costs and a reduction in mechanical and construction problems.

The use of hexavalent chromium as primary oxygen source in the autothermal reforming of light hydrocarbons is extremely surprising, as it is impossible (Mellor, "Inorganic and Theoretical Chemistry" Chromium, 211–225) to oxidize trivalent chromium to hexavalent chromium operating under the conditions existing inside the regenerator. In theory, consequently, it could not be used in partial oxidation processes where the primary oxygen source comes from a metal oxide. It has been observed however, that by fixing chromium on suitable carriers, as illustrated below, it is possible to activate the catalytic partial oxidation process of a light hydrocarbon by exploiting the reversible redox reaction of chromium between oxidation states III and VI.

An object of the present invention therefore relates to a process for the production of synthesis gas, by means of the catalytic partial oxidation or autothermal reforming of light hydrocarbons, which comprises partially oxidizing the hydrocarbon with oxygen coming from the reduction of at least one metal oxide selected from hexavalent chromium oxide, supported on an inert carrier and modified with an alkali and/or alkaline earth metal, and metal oxides capable of autonomously sustaining the catalytic partial oxidation reaction by means of redox cycles such as silver oxide, nickel oxide and lead oxide.

According to the present invention, the oxides mentioned above can also be used in a mixture with other metal oxides capable of undergoing redox cycles, such as for example, oxides of copper, magnanese, vanadium, cerium, titanium, iron, cobalt, praseodymium, bismuth, zinc, antimony and molybdenum in such quantities as to maintain the formation reaction of synthesis gas globally exothermic. These of oxides generally range from 0 to 50% by weight, calculated with respect to the total.

A particularly preferred metal oxide for the process for the production of synthesis gas object of the present invention is hexavalent chromium oxide. A further object of the present invention therefore relates to a process for the production of synthesis gas by means of the catalytic partial oxidation reaction or autothermal reforming of light hydrocarbons, which comprises:

i) partially oxidizing the hydrocarbon with oxygen coming from the reduction reaction of an oxidizing system, comprising hexavalent chromium oxide, according to the scheme:

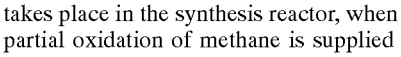

$$4CrO_3=2Cr_2O_3+3O_2 \quad \text{(IV)}$$

wherein the chromium oxides of reaction (IV) are supported on an inert inorganic material modified with an alkali and/or alkaline earth metal; and (ii) re-oxidizing the supported $Cr_2O_3$ to $CrO_3$ by means of air in a reactor maintained at a temperature which is substantially equal to or lower than that present in the reactor of step (i).

According to the present invention, therefore, the oxidizing system comprises chromium VI oxide alone or, alternatively, chromium VI oxide mixed with other metal oxides capable of undergoing redox cycles, such as for example, the oxides previously mentioned, in such proportions as to maintain the formation reaction of synthesis gas globally exothermic. Also in this case, this proportion of oxides generally ranges from 0 to 50% by weight, calculated with respect to the total.

The chromium III oxide, promoted with an alkali and/or alkaline earth oxide, for example with potassium oxide, is supported on a microspheroidal alumina (average particle diameter ranging from 40 to 100 micron) modified by addition of silica (0.1–10%), preferably from 1 to 3%. The specific surface of the alumina ranges from 30 to 200 $m^2/g$, whereas the quantity of chromium oxide varies from 1 to 30% by weight and that to the potassium oxide from 1 to 10% by weight with respect to the total. The catalyst is prepared by "incipient wetness" of alumina with an aqueous solution containing the suitable quantity of potassium dichromate dissolved, to formulate the catalyst with the established charge of chromium III oxide. If a molar ratio Cr/K different from 1 is to be obtained, and this also can be effected with a precursor for the chromium different from dichromate, and this also applies to the potassium. After the impregnation, the impregnate is dried within a temperature range of 100 to 120° C. for 4 hours, and the dried product is finally calcined within a temperature range of 800 to 900° C. for 4 hours.

Even more specifically, an object of the present invention relates to a continuous process for the production of synthesis gas by the autothermal reforming of light hydrocarbons which comprises:

a) feeding the hydrocarbon stream in gas phase to a first fluid bed partial oxidation reactor, containing a solid of the type described above, comprising $CrO_3$, in its partially oxidized state;

b) discharging a gas stream essentially consisting of $H_2$, CO and, optionally, the non-reacted hydrocarbon phase, from the head of the first reactor;

c) collecting at the bottom of the first reactor a solid containing chromium III oxide and feeding this to a second fluid bed regeneration reactor maintained at a temperature substantially equal to or lower than that present in the oxidation reactor;

d) feeding to the bottom of the second regeneration reactor a stream of air at high temperature;

e) recycling the regenerated solid to the first oxidation reactor.

Any light hydrocarbon can be used in the process object of the present invention. Light paraffins are generally used, such as methane or ethane, or, alternatively, liquefied petroleum gas (LPG), refinery gas, naphthas, such as "virgin naphtha" or "cracked naphtha", etc. The preferred hydrocarbon stream however is methane.

A temperature ranging from 800 to 1100° C., preferably from 900 to 1000° C. and a pressure ranging from 0.5 to 5 MPa, preferably from 1 to 3 MPa, is maintained in the first fluid bed oxidation reactor. Due to the effectiveness of the partial oxidation reaction, this temperature is reached and kept constant by the exothermicity of the reaction itself, without requiring supplementary external supplies of heat or additional oxidizing sources. The hydrocarbon stream is fed to the first reactor after being preheated to a temperature ranging from 400 to 600° C.

The synthesis gas thus obtained, after being discharged from the first reactor, is cooled, with the recovery of heat, and treated to eliminate the reaction byproducts, for example water and carbon dioxide, and recover the non-reacted hydrocarbon phase. After filtration to eliminate the powders of entrained solid material, it can then be sent to subsequent syntheses, for example for the production of methanol or paraffinic waxes according to the Fischer-Tropsch technology. For this purpose the partial oxidation reaction is carried out with feedings and/or operating conditions which are such as to produce a synthesis gas with a molar ratio $H_2/CO$ suitable for the above syntheses. The molar ratio $H_2/CO$ generally ranges from 1 to 4.

In the partial oxidation reaction of the light hydrocarbon according to the present invention, the oxygen is supplied by the oxidizing system, for example by the oxidizing system comprising hexavalent chromium oxide which is gradually reduced according to reaction scheme (IV) to trivalent chromium. To obtain a gradual passage between these two oxidation states, the solid containing chromium VI oxide is charged into the upper part of the oxidation reactor and maintained in fluid state, by the hydrocarbon stream, so as to slowly descend towards the bottom in countercurrent with the gas phase which is rising. During this descent, the chromium VI oxide is gradually reduced to chromium III oxide, releasing the oxygen necessary for the partial oxidation reaction.

The exhausted solid is therefore collected on the bottom of the first reactor and is continuously removed and fed to the second fluid bed regeneration reactor. The same operating conditions present in the first reactor are substantially maintained inside this second reactor. The regeneration reactor operates with temperatures equal to or lower than those present in the partial oxidation reactor, for example with temperatures ranging from 750 to 1050° C., preferably from 850 to 950° C.

The fluid bed regeneration reactor substantially operates in the same way as the first. The exhausted solid is charged to the upper part of the reactor and maintained in fluid state by preheated air, so as to slowly descend towards the bottom in countercurrent with the gas phase which is rising. During this descent, the exhausted oxidizing system, for example chromium III oxide, is gradually oxidized to chromium VI oxide.

The regenerated solid is therefore collected on the bottom of the second reactor and is continuously recycled to the first reactor. The exhausted hot air, essentially consisting of nitrogen, is cooled, filtered and discharged to a chimney.

The enclosed figure provides a scheme which is purely illustrative of the continuous process for the production of synthesis gas object of the present invention and in which the oxidizing system consists of chromium VI oxide. With reference to the drawing, (2) and (7) respectively represent the oxidation and regeneration reactors whereas (4) and (10) are the conveying lines which send the exhausted solid to the regeneration reactor and the reoxidized solid to the oxidation reactor, respectively.

The light hydrocarbon, for example methane, is fed to the base of the reactor (2) through line (1) by means of a suitable distributor, not shown in the figure and, as it flows upward, it maintains the solid in fluid state, undergoing partial oxidation. The synthesis gas thus obtained is discharged at the head by means of line (3).

The chromium oxide $Cr_2O_3$, supported on an inert inorganic material, for example, alumina, is collected on the bottom of the reactor (2) and is pneumatically sent by means of transfer line (4) and with the introduction of conveying gas, for example air or nitrogen, (5) and (6), to the upper part of the regeneration reactor (7).

The air for the oxidation entering reactor (7) through line (8), optionally enriched with oxygen, is fed to the base of the reactor (7) by means of a suitable distributor, not illustrated in the figure, and, as it flows upward, it maintains the solid in fluid state while oxidizing the chromium III to chromium VI. The exhausted air is discharged at the head by means of a (9).

The chromium oxide $CrO_3$, again supported on alumina, is collected on the bottom of the reactor (7) and is pneumatically sent by means of transfer line (10) and with the introduction of carrier gas, for example methane, through lines (11) and (12) to the upper part of the oxidation reactor (2).

An illustrative but non-limiting example is provided hereunder for a better understanding of the present invention.

EXAMPLE 1

Reference is made to the drawing of the enclosed figure wherein the oxidation reactor has an internal diameter of 3.5 cm and the regenerator an internal diameter of 5 cm. 3600 grams of solid material in the form of microspheroidal particles with an average particle diameter equal to 70 micrometers are charged into the two containers. The material consists of alumina containing 1.6% of silica and is impregnated with 20% by weight of $Cr_2O_3$ and 3% by weight of potassium ions. The preparation procedure is identical to that described above.

Once the catalyst is fluidized in the two reaction containers, the following distribution of solid material is obtained: 2000 grams are present in the regenerator, 1400 grams are present in the reactor and the remaining 200 grams are equally subdivided between the two conveying lines.

The conveying of the catalyst between the two containers is regulated so as to have, in both directions, a flowrate equal to 25 Kg/h of solid material.

The regenerator is maintained at a temperature of 700° C. and at a pressure of 2 MPa. A flow-rate of 650 Nl/h of air preheated to 700° C. is fed to the regenerator. The oxygen contained in the air reacts with the chromium III oxide, distributed on the surface of the particles, transforming it into chromium VI oxide. In this way 3.3 moles/h of $Cr_2O_3$ contained in the solid material, corresponding to about 10% of the total chromium, are transformed into $CrO_3$.

The effluent gas from the regenerator has a flow-rate of 538 Nl/h and consists of 95.4% (molar) of nitrogen and the remaining 4.6% of oxygen.

The regenerated solid material is pneumatically conveyed to the top of the reactor with a flow-rate of 3.3 moles/h of $CrO_3$. The reactor is fed with a flow-rate of 172 Nl/h of methane and is maintained at a temperature of 900° C., owing to the exothermicity of the oxidation reaction, and a pressure of 20 atm.

The $CrO_3$ is reduced, under the operating conditions of the reactor, releasing oxygen which reacts with the methane to form synthesis gas. In particular, the effluent stream from the reactor has a flow-rate of 516 Nl/h and the following molar composition: 60.2% of $H_2$; 30.6% of CO; 2.5% of $CO_2$; and 6.5% of $H_2O$ vapor.

EXAMPLE 2

The same procedure is substantially adopted as in example 1 but with a catalyst consisting of alumina containing 1.6% of silica, 3% of $K^+$ and impregnated with a mixture of $Cr_2O_3/CeO_2$ in a ratio of 20/1 ml. The reactor is maintained at a temperature of 900° C.

The effluent stream from the reactor, i.e. the synthesis gas produced, and the quantities of catalyst used are substantially equal to those of the previous example.

EXAMPLE 3

The same operating conditions are adopted as in example 1 but with a catalyst consisting of alumina containing 1.6% of silica, 3% of $K^+$ and impregnated with a mixture of $Cr_2O_3/Mn_2O_3$ in a ratio of 20/1 mol. The reactor is maintained at a temperature of 900° C.

The effluent stream from the reactor, i.e. the synthesis gas produced, and the quantities of catalyst used are substantially equal to those of the previous example.

What is claimed is:

1. A process for the production of synthesis gas, which comprises:

partially oxidizing or autothermally reforming a light hydrocarbon gas with a solid comprising hexavalent chromium oxide, supported on an inert carrier and modified with an alkali or alkaline earth metal, and metal oxides that are capable of autonomously sustaining the catalytic partial oxidation reaction by means of redox cycles, wherein the light hydrocarbon contacts the chromium oxide and extracts oxygen therefrom thereby partially reducing said hexavalent chromium oxide.

2. The process according to claim 1, wherein the chromium VI oxide is used in a mixture with said other metal oxides, capable of undergoing redox cycles, in such proportions as to maintain the formation reaction of synthesis gas globally exothermic.

3. The process according to claim 2, wherein the other metal oxide mixed with the hexavalent chromium oxide is an oxide of copper, manganese, vanadium, cerium, titanium, iron, cobalt, praseodymium, bismuth, zinc, antimony or molybdenum.

4. The process according to claim 1, wherein in the oxidation reaction in an oxidation reactor the hexavalent chromium oxide is reduced according to the equation:

$$4CrO_3 = 2Cr_2O_3 + 3O_2 \quad \text{(IV)}$$

and wherein the $Cr_2O_3$ produced by the oxidation of the light hydrocarbon is re-oxidized to $CrO_3$ by means of air in a reactor maintained at a temperature which is substantially equal to or lower than the temperature in the oxidation reactor.

5. The process according to claim 4, which comprises:

(a) feeding the light hydrocarbon in gas phase to a first fluid bed partial oxidation reactor, containing the solid, comprising $CrO_3$:

(b) discharging a gas stream essentially consisting of $H_2$, CO and, optionally, the nonreacted hydrocarbon phase, from the head of the first reactor;

(c) collecting a solid containing chromium III oxide from the bottom of the first reactor and feeding the collected solid to a second fluid bed regeneration reactor maintained at a temperature substantially equal to or lower than the temperature in the oxidation reactor;

(d) feeding a stream of air at high temperature to the bottom of the second regenerator reactor; and (e) recycling the regenerated solid to the first oxidation reactor.

6. The process according to claim 5, wherein in the first fluid bed oxidation reactor a temperature ranging from 800 to 1100° C. is maintained, together with a pressure ranging from 0.5 to 5 MPa.

7. The process according to claim 6, wherein in the second regeneration reactor the same operating conditions present in the first reactor are substantially maintained.

8. The process according to claim 1, wherein the light hydrocarbon is methane ethane, liquified petroleum gas, refinery gas or a naphtha.

9. The process according to claim 8, wherein the light hydrocarbon is methane.

10. The process according to claim 1, wherein the inert carrier of the solid is microspheroidal alumina modified by the addition of silica thereto.

11. The process according to claim 10, wherein the microspheroidal alumina has a particle size of 40 to 100 microns and from 0.1 to 10% by wt of silica is added thereto.

12. The process according to claim 11, wherein the content of chromium trioxide in the oxide ranges from 1 to 30 wt % and wherein the alkali or alkaline earth metal is potassium and wherein the content of said potassium in the solid ranges from 1 to 10 wt %, each with respect to the total weight of the solid.

13. The process according to claim 1, wherein the alkali metal is potassium.

14. The process according to claim 1, wherein the metal oxides that are capable of autonomously sustaining the catalytic partial oxidation reaction by means of redox cycles are selected from the group consisting of silver oxide, nickel oxide and lead oxide.

15. A process for the production of synthesis gas, which comprises:

feeding a hydrocarbon stream into a reactor in which a light hydrocarbon gas solely is partially oxidized or autothermally reformed to a synthesis gas in the presence of hexavalent chromium oxide supported on an inert carrier and modified with an alkali or, alkaline earth metal, and metal oxides that are capable of autonomously sustaining the catalytic partial oxidation reaction by means of redox cycles, the hexavalent chromium oxide functioning as a source of oxygen for the oxidation of the light hydrocarbon gas and thereby being partially reduced.

* * * * *

UNITED STATES PATENT AND TRADEMARK OFFICE

CERTIFICATE OF CORRECTION

PATENT NO. : 6,833,013 B1
DATED : December 21, 2004
INVENTOR(S) : Sanfilippo et al.

It is certified that error appears in the above-identified patent and that said Letters Patent is hereby corrected as shown below:

Title page,
Insert Items [45] and [*] Notice, as follows:
-- [45] **Date of Patent: * Dec. 21, 2004** --

[*] Notice: Subject to any disclaimer, the term of this patent is extended or adjusted under 35 U.S.C. 154(b) by 0 days.

This Patent is subject to a terminal disclaimer. --

Signed and Sealed this

Thirty-first Day of May, 2005

JON W. DUDAS
*Director of the United States Patent and Trademark Office*